US011878391B2

(12) United States Patent
McLain

(10) Patent No.: US 11,878,391 B2
(45) Date of Patent: Jan. 23, 2024

(54) ADJUSTABLE STROKE DEVICE

(71) Applicant: Lake Country Tool, LLC, Oconomowoc, WI (US)

(72) Inventor: Scott S. McLain, Mukwonago, WI (US)

(73) Assignee: Lake Country Tool, LLC, Oconomowoc, WI (US)

( * ) Notice: Subject to any disclaimer, the term of this patent is extended or adjusted under 35 U.S.C. 154(b) by 0 days.

(21) Appl. No.: 17/687,010

(22) Filed: Mar. 4, 2022

(65) Prior Publication Data

US 2023/0278161 A1 Sep. 7, 2023

(51) Int. Cl.

| | |
|---|---|
| ***B24B 47/12*** | (2006.01) |
| ***B24B 23/02*** | (2006.01) |
| ***B24B 41/04*** | (2006.01) |
| ***B24B 23/04*** | (2006.01) |
| ***B24B 23/03*** | (2006.01) |

(52) U.S. Cl.

CPC ..... *B24B 47/12* (2013.01); *B24B 23/028* (2013.01); *B24B 23/03* (2013.01); *B24B 23/04* (2013.01); *B24B 41/042* (2013.01)

(58) Field of Classification Search

CPC ..... B24B 23/04; F16H 19/08
USPC ..... 74/25
See application file for complete search history.

(56) References Cited

U.S. PATENT DOCUMENTS

| | | | |
|---|---|---|---|
| 169,753 | A | 11/1875 | White |
| 3,898,887 | A | 8/1975 | Grant |
| 4,328,718 | A | 5/1982 | Robinson et al. |
| 4,610,111 | A | 9/1986 | Cox |
| 5,020,281 | A | 6/1991 | Neff |
| 5,134,777 | A | 8/1992 | Meyer et al. |
| 5,879,228 | A | 3/1999 | Sun |

(Continued)

FOREIGN PATENT DOCUMENTS

| | | | |
|---|---|---|---|
| CN | 206356999 | U | 7/2017 |
| DE | 102004055271 | A1 | 5/2006 |

(Continued)

OTHER PUBLICATIONS

European Search Report dated Mar. 26, 2019 in corresponding European Application No. 18203189.8.

(Continued)

*Primary Examiner* — Randell J Krug
(74) *Attorney, Agent, or Firm* — Harness, Dickey & Pierce, P.L.C.

(57) ABSTRACT

An automatic adjustable stroke device for a random orbital machine has a housing with a central axis and a wall defining a cavity. A counterbalance shaft assembly is rotatably disposed at least partially within the cavity. A shaft portion of the counterweight shaft assemblies aligned with the central axis. A mounting assembly is disposed at least partially within the cavity. The mounting assembly has a workpiece attachment mechanism. A stroke adjuster couples the counterweight shaft with the mounting assembly. The stroke adjuster enables the mounting assembly to adjust its stroke upon rotation of counterweight shaft. The mounting assembly variably adjusts a stroke radius of the workpiece attachment mechanism with respect to the central axis of the housing. The stroke adjuster has a gear automatically adjusting the mounting assembly stroke.

17 Claims, 7 Drawing Sheets

(56) References Cited

U.S. PATENT DOCUMENTS

| | | | |
|---|---|---|---|
| 5,904,027 | A | 5/1999 | Bonde |
| 5,947,804 | A | 9/1999 | Fukinuki et al. |
| 6,062,960 | A | 5/2000 | Kai et al. |
| 6,089,065 | A | 7/2000 | Deriaz |
| 6,206,771 | B1 | 3/2001 | Lehman |
| 6,796,203 | B2 | 9/2004 | Dubrowskij |
| 7,238,095 | B1 | 7/2007 | Sun et al. |
| 7,241,209 | B2 | 7/2007 | Wiltshire |
| 8,740,669 | B2 | 6/2014 | McFadden et al. |
| 10,144,106 | B2 | 12/2018 | McLain et al. |
| 11,493,115 | B2 | 11/2022 | McLain et al. |
| 11,674,571 | B2 | 6/2023 | McLain et al. |
| 2004/0187324 | A1 | 9/2004 | James et al. |
| 2005/0090190 | A1 | 4/2005 | Rudolph |
| 2005/0197052 | A1 | 9/2005 | Lampka et al. |
| 2005/0245182 | A1 | 11/2005 | Deshpande et al. |
| 2006/0289264 | A1 | 12/2006 | Zhong |
| 2007/0224924 | A1 | 9/2007 | Hoglund |
| 2008/0057842 | A1 | 3/2008 | Lampka et al. |
| 2017/0120413 | A1* | 5/2017 | McLain ..... B24B 23/03 |
| 2018/0339396 | A1 | 11/2018 | Mclain et al. |
| 2020/0072292 | A1 | 3/2020 | McLain |

FOREIGN PATENT DOCUMENTS

| | | | |
|---|---|---|---|
| EP | 0 157 532 | A1 | 10/1985 |
| EP | 0272725 | A2 | 6/1988 |
| EP | 0573916 | A1 | 12/1993 |
| EP | 0 820 838 | A1 | 1/1998 |
| EP | 1 688 217 | A2 | 8/2006 |
| EP | 2072183 | A1 | 6/2009 |
| EP | 2 127 808 | A1 | 12/2009 |
| EP | 3162499 | A2 | 5/2017 |
| EP | 3 476 538 | A1 | 5/2019 |
| EP | 3693132 | A1 | 8/2020 |
| GB | 2 420 518 | A | 5/2006 |
| JP | 2001-179591 | A | 7/2001 |
| WO | WO-99/21686 | A1 | 5/1999 |

OTHER PUBLICATIONS

European Search Report dated Oct. 14, 2022 in corresponding European Application No. 22151499.5.

European Search Report dated Aug. 4, 2023 in corresponding European Application No. 23158102.6.

* cited by examiner

ADJUSTABLE STROKE DEVICE

FIELD

The present disclosure relates to random orbital devices including, but not limited to polishers, buffers, sanders and massagers.

BACKGROUND

The present disclosure relates to an apparatus for automatically randomly alternating the stroke of a random orbital machine, such as, but limited to, polishing machines, sanding machines and massaging machines. This enables the user to have a defined random stroke of the random orbital machine.

Polishing machines and sanding machines are routinely used in the automotive detailing industry and home building industry to correct imperfections in the paint or drywall and to apply polishes and waxes. There are three primary machines used, including rotary buffers, random orbital machines, and dual action machines. Each tool has its place, as the manner where the pad spins on each machine is unique and used for different purposes.

Rotary buffers are the fastest and most effective machine for removing paint defects in a controlled manner with good results. The drive unit used in a rotary buffer is directly connected to the pad and each one is in axial alignment with each other. In order to correct paint scratches, the rotary buffer is commonly used to remove enough paint surrounding the scratches to make the surface level. Removing scratches, however, requires more skill and control of the machine than a typical hobbyist possesses. For this reason, rotary buffers are commonly avoided by average users as it is very easy to remove too much paint and damage the finish by causing swirl marks or by burning the paint.

Random orbital machines were introduced in order to meet the needs of an average user, as they require less experience and control to operate. A random orbital machine uses a gear case that employs two unique mechanisms that move a pad attached to a backing plate. Unlike a rotary buffer, random orbital machines place the central rotational axis of the pad and the backing plate offset from the driveshaft of the machine. This offset is commonly referred to as the "stroke". As a result, the backing plate and pad orbit the driveshaft in a circular motion. At the same time, the pad randomly spins, as it is mounted on an idle bearing. This random spinning varies with pressure applied on the pad and is not directly powered. The result is a polishing action that will not burn or cut through the paint as it will not produce the heat from a powered spinning action. Random orbital machines are, therefore, much safer and dramatically less likely to cause swirls or burn through the paint.

Similar to random orbital machines, dual action machines place the central rotational axis of the pad and the backing plate offset from the driveshaft. As a result of this stroke, the backing plate and pad orbit the driveshaft in a circular motion. However, with a dual action machine the spinning of the pad is directly powered.

At the heart of a random orbital machine is the machine's stroke. The stroke is determined by the offset between the driveshaft axis and the backing axis. A longer offset or stroke places the backing plate rotational axis farther away from the driveshaft axis. Multiplying the offset by two produces the stroke diameter. The "stroke" is, therefore, a term that identifies the diameter of the path the backing plate travels as it orbits around the driveshaft.

A majority of random orbital machines are small stroke machines, which mean they use a stroke length that measures somewhere between approximately 6 mm-12 mm. A small stroke machine limits the movement of the pad to a smaller and tighter orbit. This results in a smoother action. A small stroke machine is also easier to control because the backing plate orbits around the driveshaft rotational axis in a tighter path. There are less vibrations and movement making the machine easier to hold due to the smoother action.

A large stroke machine delivers increased orbits per minute (OPM) of backing plate motion using the same rotations per minute (RPM), as the orbit of the backing plate and the pad around the drive shaft is increased. A large stroke also increases movement of the pad which helps spread out polishing compounds and treats a larger surface area. It also accomplishes more cutting action into the paint which allows for scratches and paint defects to be corrected. Small stroke machines typically only polish the paint and do not cut into it, and, therefore, are not able to remove surface defects.

One method of addressing the deficiencies of a small stroke has been to increase the RPM of the machine. While this increases the rotation of the motor, the machine stroke stays the same. There are also longevity issues associated with increased RPM for the motor and increased OPM for the pad. Increasing the RPM puts more strain on the motor, while increased OPM burns out a pad faster.

In sum, both long stroke and short stroke machines have their place in the industry. Therefore, what is needed is a machine that can be adjusted randomly between short and long strokes without special tools or disassembly of the machine. Finally, what is needed is a compact, simple, and effective method to adjust the stroke of a machine during operation.

SUMMARY

According to the disclosure, the automatic adjustable stroke device for a random orbital machine comprises a housing having a central axis and a wall defining a cavity. A counterweight shaft assembly is rotably disposed at least partially within the cavity. A shaft portion of the counterweight shaft assembly is aligned with the central axis. A mounting assembly is disposed at least partially within the cavity. The mounting assembly includes a workpiece attachment mechanism. The stroke adjuster couples the counterweight shaft with the mounting assembly. The stroke adjuster enables the mounting assembly to adjust its stroke upon rotation of the counterweight shaft. The mounting assembly variably adjust stroke radius of the workpiece attachment mechanism with respect to the central axis of the housing. The stroke adjuster includes a drivetrain that automatically adjusts the mounting assembly stroke. The counterweight shaft assembly includes a counterweight portion. The counterweight portion is coupled with a base disk. The base disk is rotable with respect to the housing. The counterweight shaft assembly includes a bore to receive the stroke adjuster. The stroke adjuster includes a bore to receive the mounting assembly. The mounting assembly extends through the base disk to couple the workpiece attachment mechanism. The housing includes a ring gear meshing with a gear of the stroke adjuster drivetrain.

According to a second embodiment, a rotating tool comprises a housing and a motor. The motor includes a drivetrain. A counterweight shaft assembly is rotably disposed at least partially within the cavity. A shaft portion of the counterweight shaft assembly is aligned with the central axis. A mounting assembly is disposed at least partially within the cavity. The mounting assembly includes a workpiece attachment mechanism. The stroke adjuster couples the counterweight shaft with the mounting assembly. The stroke adjuster enables the mounting assembly to adjust its stroke upon rotation of the counterweight shaft. The mounting assembly variably adjust stroke radius of the workpiece attachment mechanism with respect to the central axis of the housing. The stroke adjuster includes a drivetrain that automatically adjusts the mounting assembly stroke. The counterweight shaft assembly includes a counterweight portion. The counterweight portion is coupled with a base disk. The base disk is rotable with respect to the housing. The counterweight shaft assembly includes a bore to receive the stroke adjuster. The stroke adjuster includes a bore to receive the mounting assembly. The mounting assembly extends through the base disk to couple the workpiece attachment mechanism. The housing includes a ring gear meshing with a gear of the stroke adjuster drivetrain.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
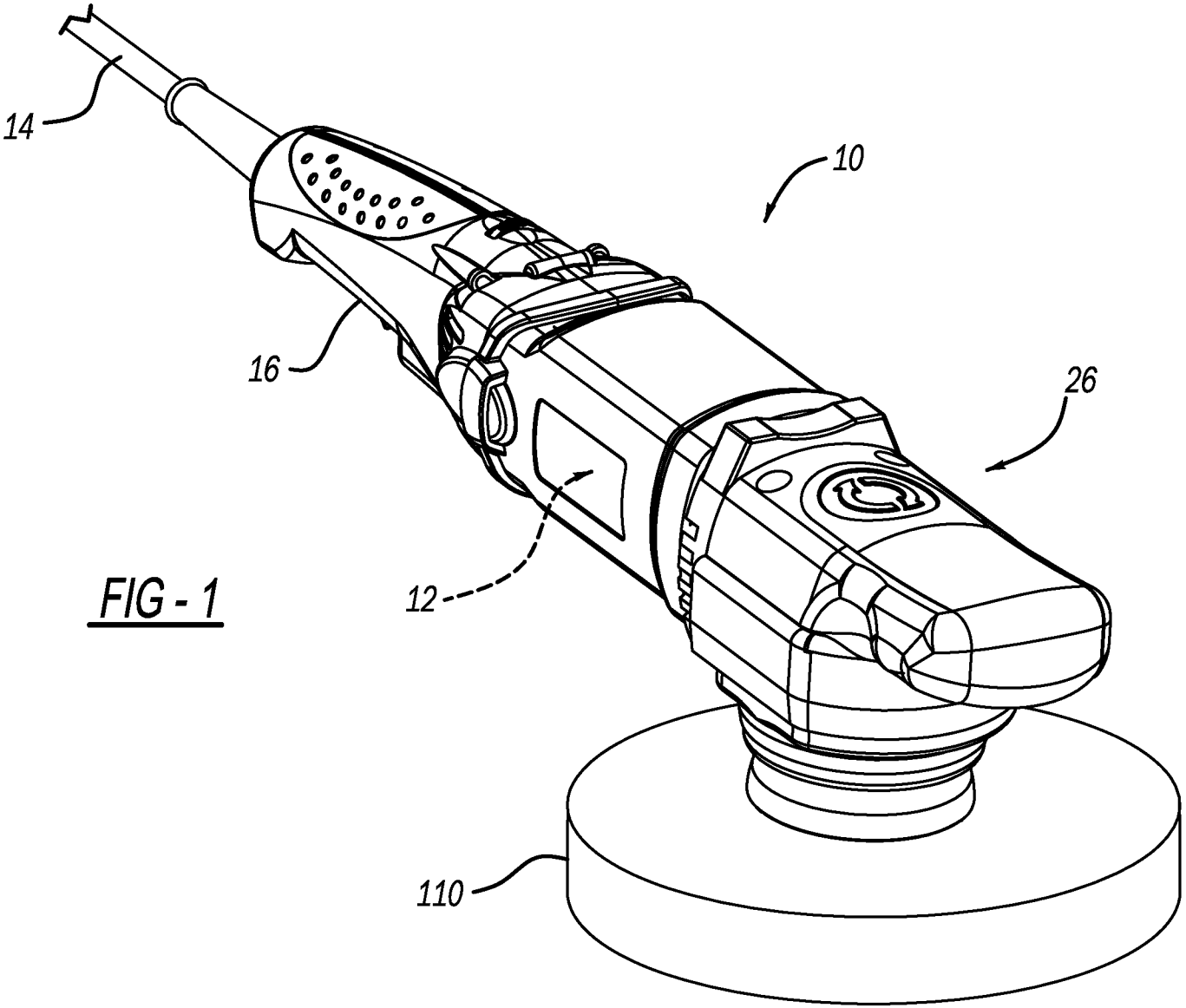
FIG. 1 is a perspective view of a rotating tool according to the disclosure.
Figure 2:
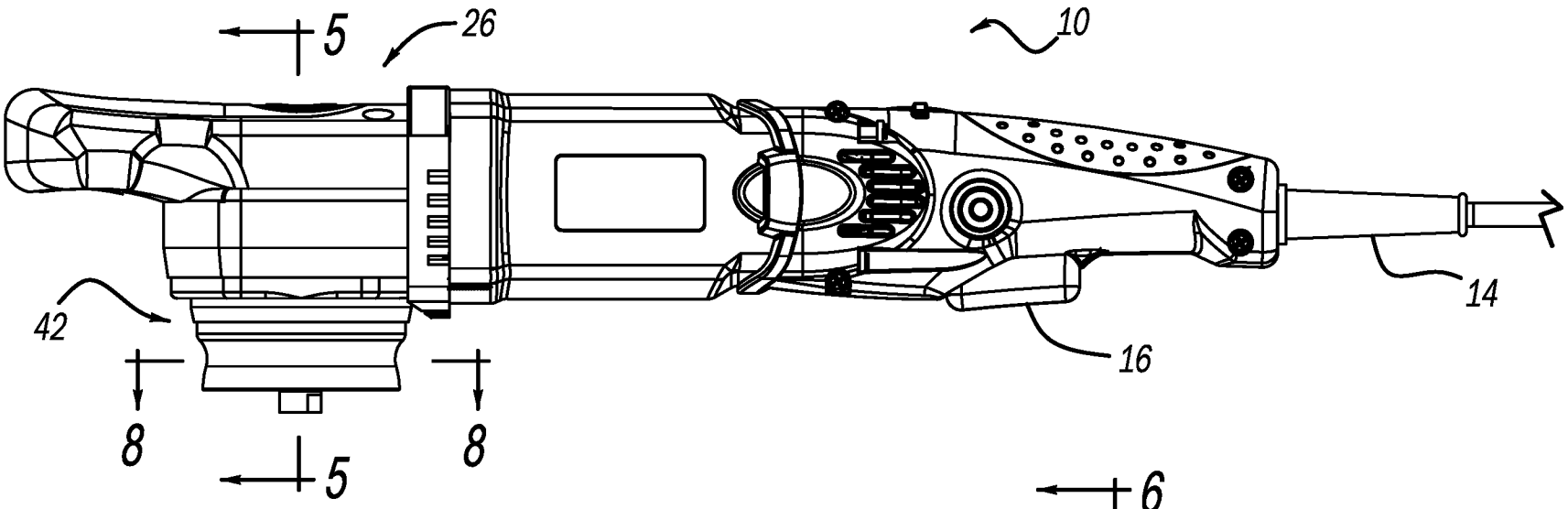
FIG. 2 is a side elevation view of the tool of FIG. 1.
Figure 3:
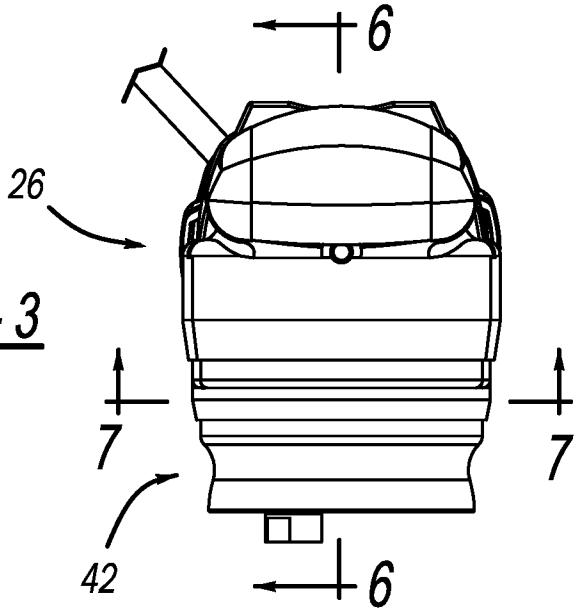
FIG. 3 is a front elevation view of FIG. 1.
Figure 4:
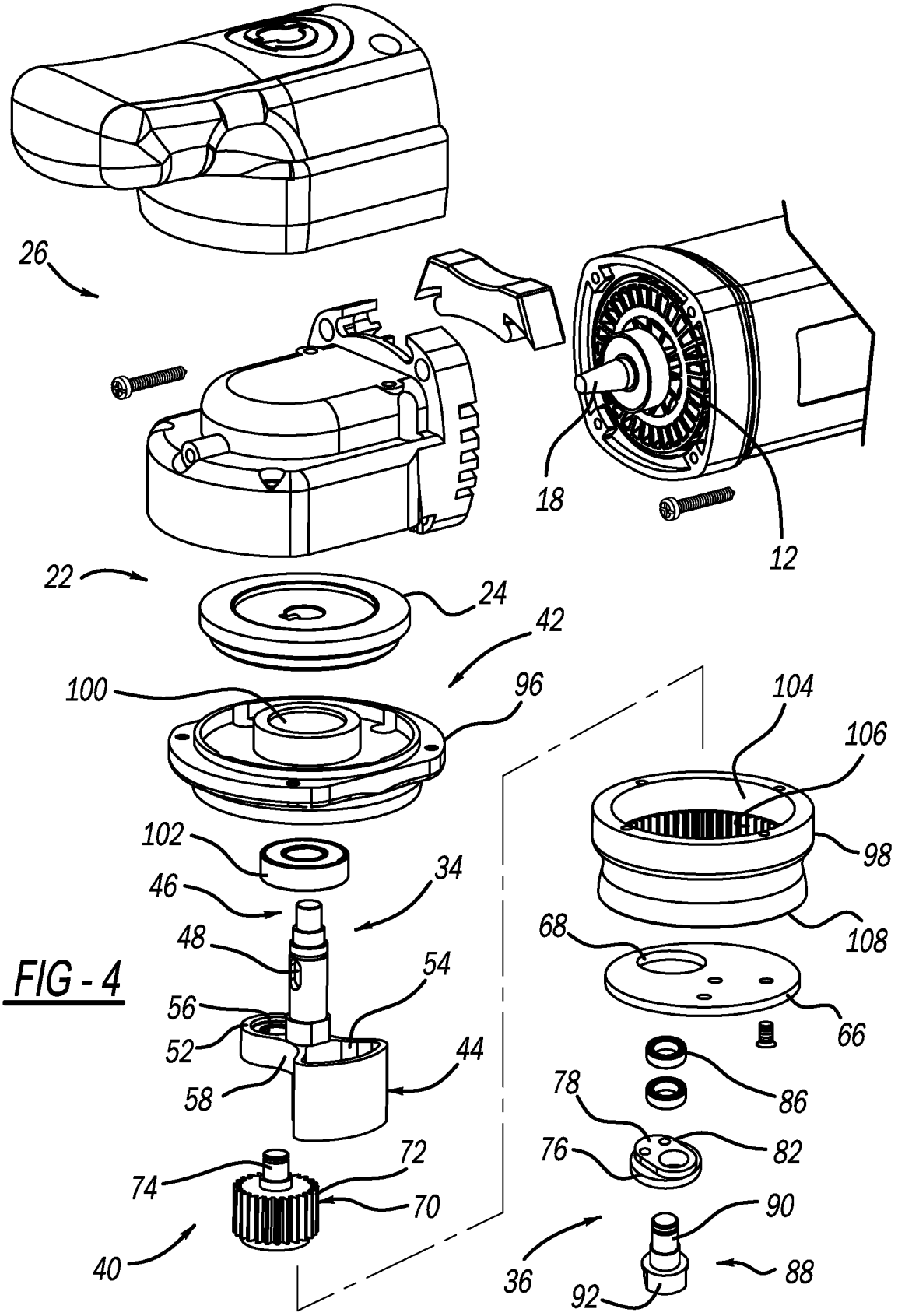
FIG. 4 is an exploded view of the adjustable stroke device.
Figure 5:
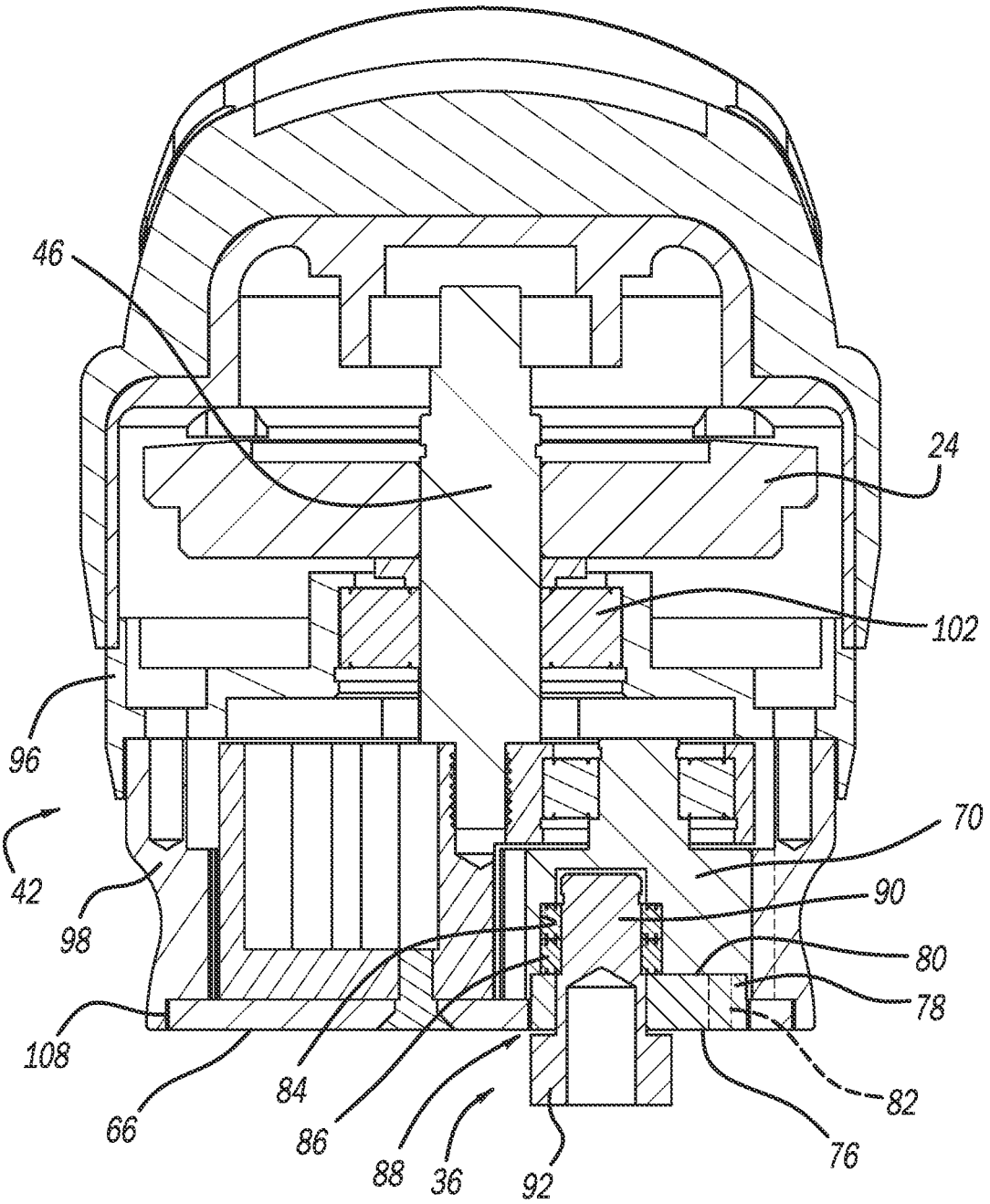
FIG. 5 is a cross-sectional view of FIG. 2 along line 5-5.
Figure 6:
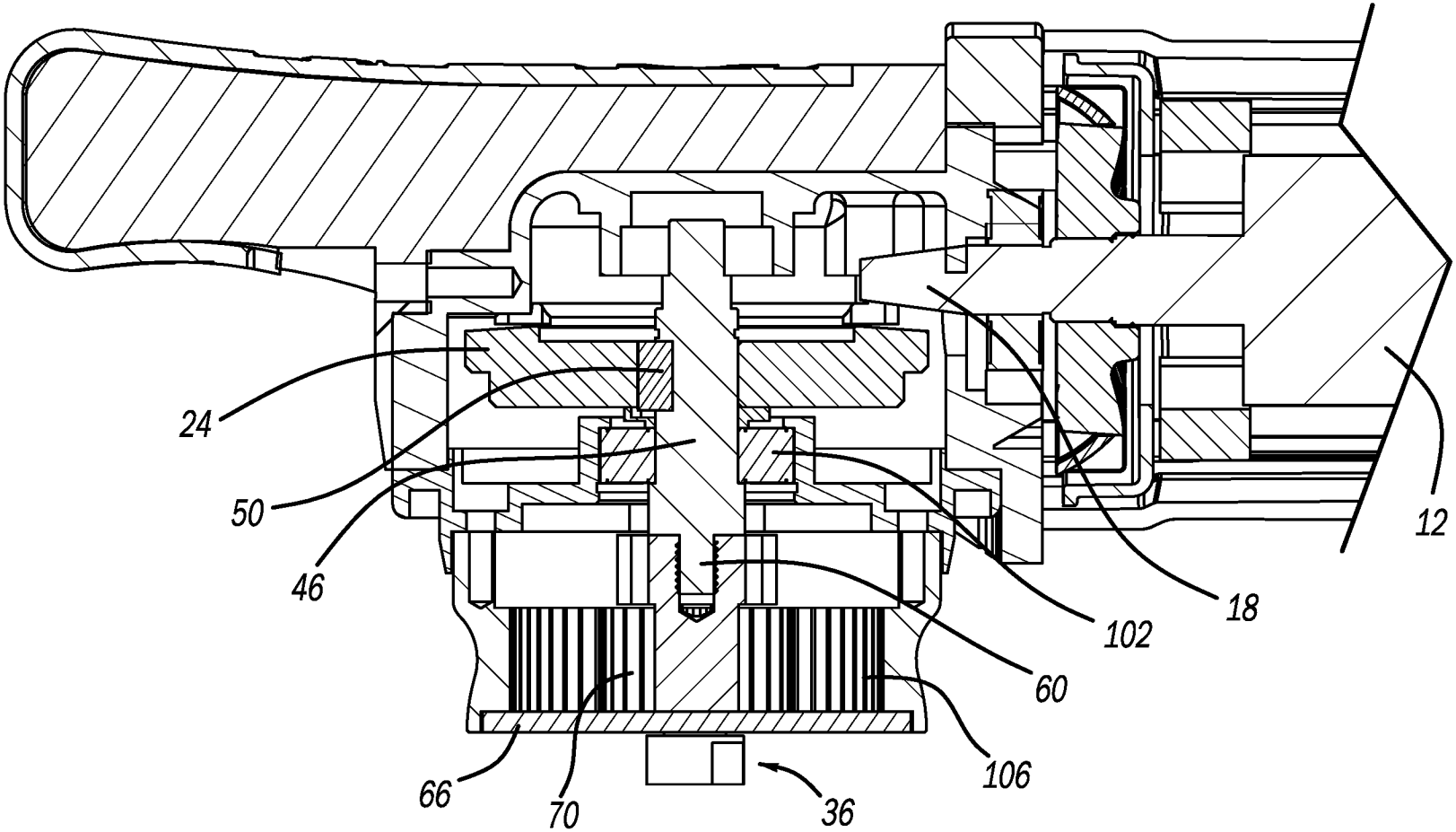
FIG. 6 is a cross-sectional view of FIG. 3 along line 6-6.
Figure 7:
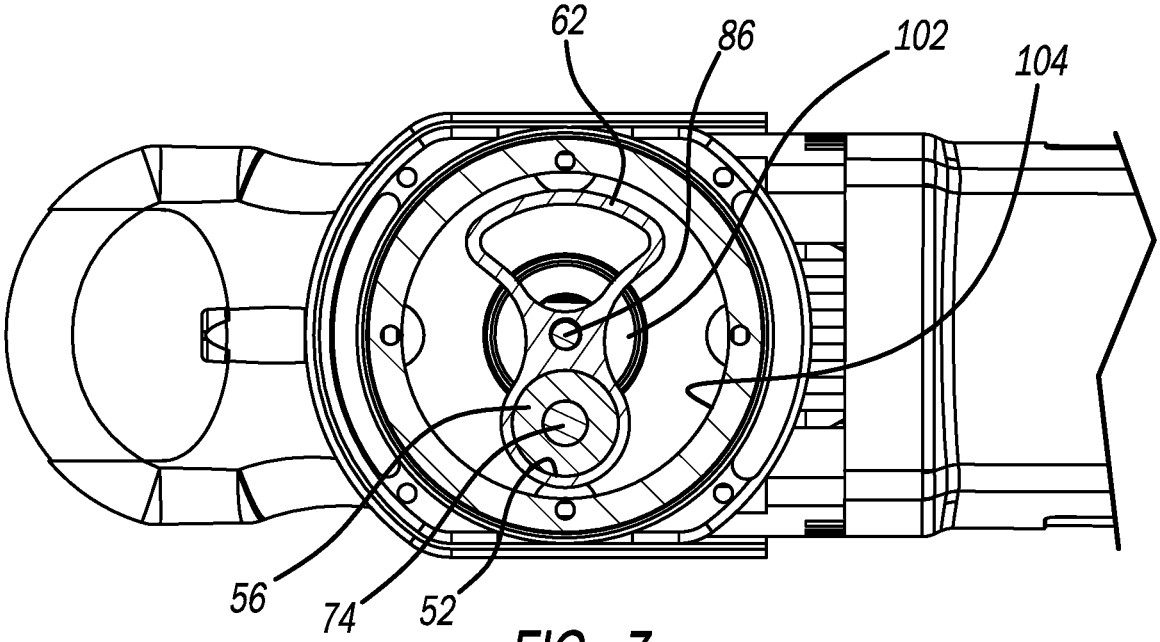
FIG. 7 is a cross-sectional view of FIG. 3 along line 7-7.
Figure 8:
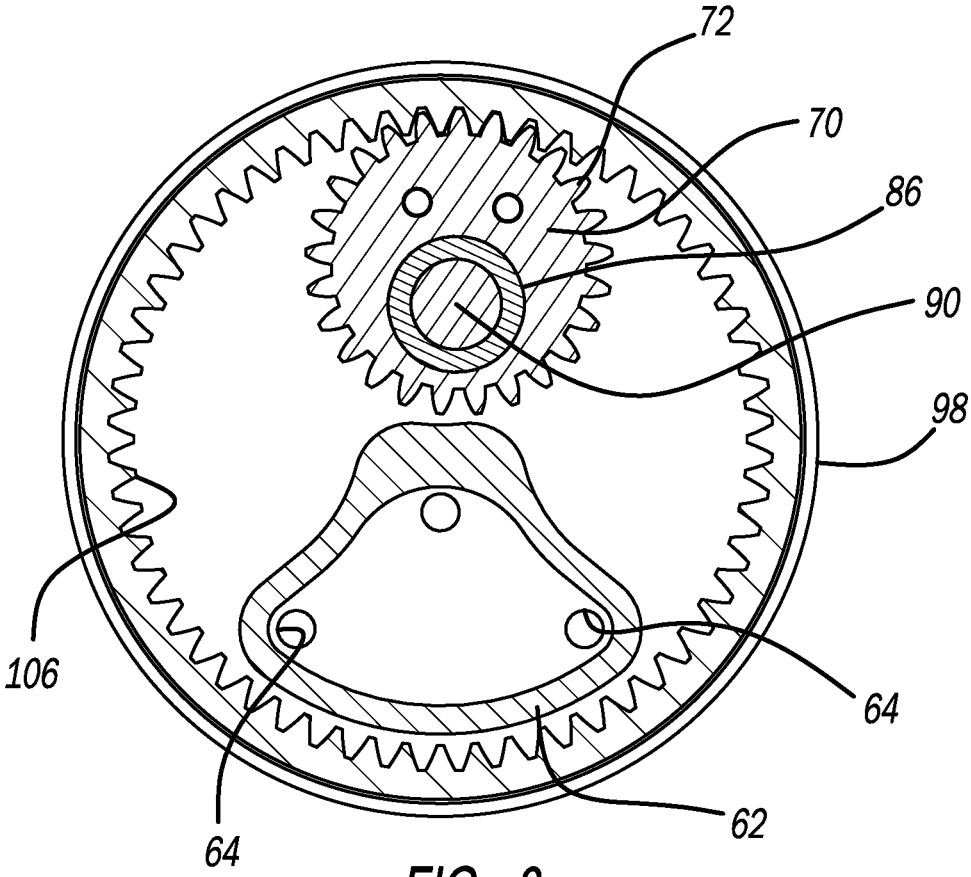
FIG. 8 is a cross-sectional view of FIG. 2 along line 8-8.
Figure 9A:
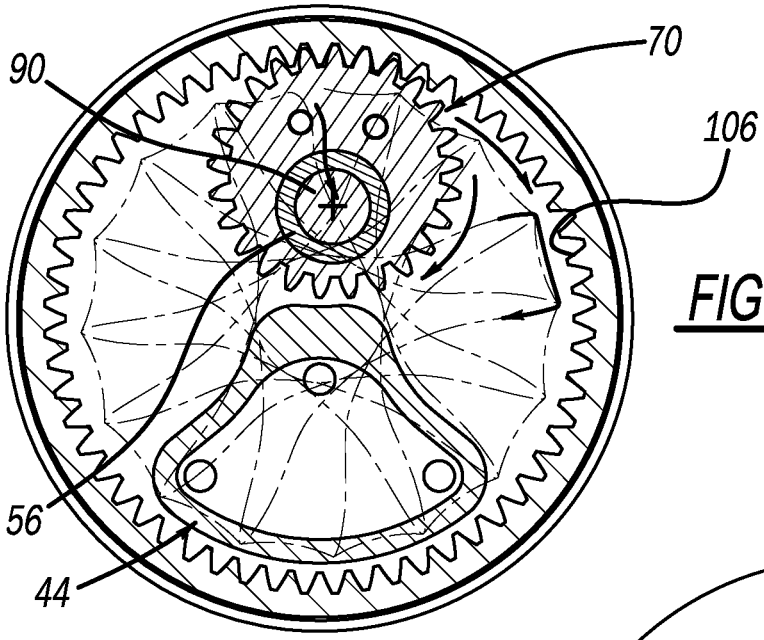
Figure 9B:
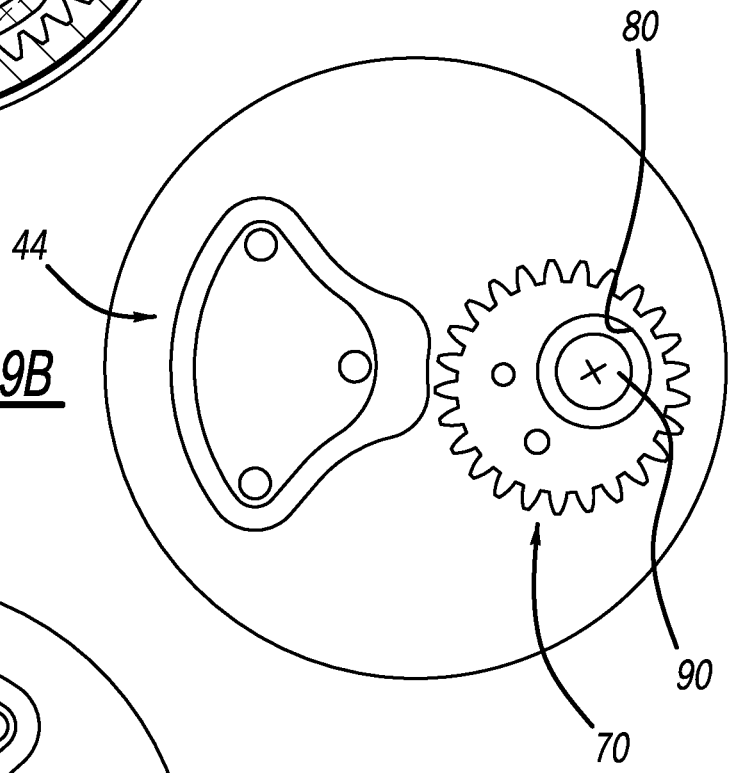
Figure 9C:
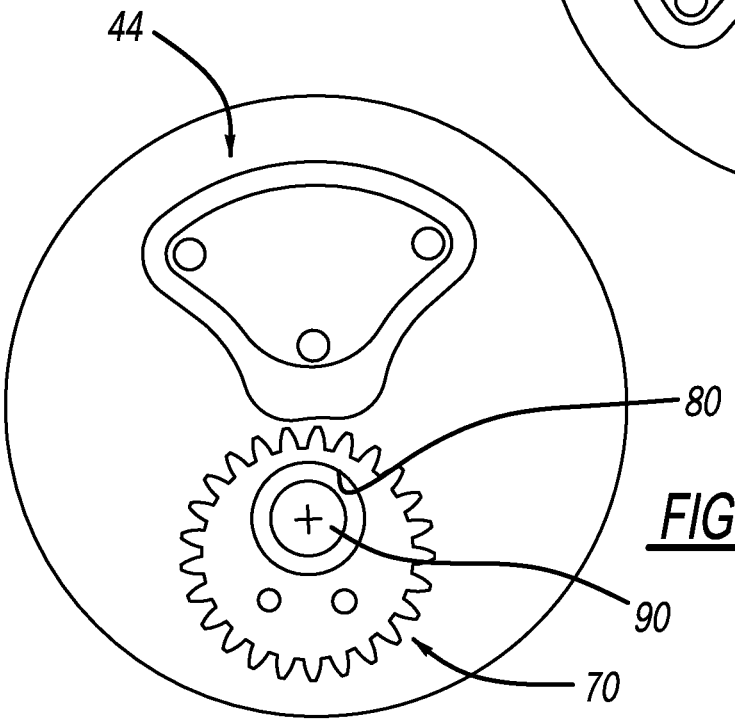

FIGS. 9A-C are cross-sectional views like FIG. 8 with path tracks in phantom.

DETAILED DESCRIPTION

Example embodiments will now be described more fully with reference to the accompanying drawings.

Turning to the figures, a tool is illustrated with an automated adjustable stroke device and is designated with the reference numeral 10. The tool includes a motor 12, a power source 14 and switch 16 to activate and deactivate the power source. The power source is shown as a cord but could be rechargeable batteries. The motor includes a pinion 18 positioned inside the head housing 26 of the tool. The drivetrain head housing 26 includes a cavity to house a drivetrain 22. The drivetrain 22 includes a bevel gear meshing with the pinion 18. The bevel gear 24 is coupled with the automatic adjustable stroke device 30 which is mounted, via housing 32, with the bottom of the head housing 26.

The adjustable stroke device 30 includes a counterbalance assembly mechanism 34, a workpiece mounting assembly 36 and a stroke adjustment mechanism 40. A housing 42 covers the counterbalance assembly 34, workpiece mounting assembly 36 and stroke adjustment mechanism 40. The housing 42 defines a cavity that houses the elements.

The counterbalance assembly 34 includes a counterbalance weight 44 secured with a shaft 46. The shaft 46, has the bevel gear 24 secured at one end. The other end of the shaft 46 is secured with the counterweight 44. The shaft 46 includes a key recess 48 that receives key 50 to retain the bevel gear 24 on the shaft 46.

The counterweight 44 has an overall infinity shape with a pair of bores 52, 54. The bore 52 receives a bearing 56 of the stroke adjustment mechanism 40. The web 58, between the bores 52, 54, includes a threaded bore to receive a threaded portion 60 of the shaft 46. A weight portion 62, with bore 54, includes bores 64 on the weight portion 62 to receive fasteners to couple plate 66 with the weight portion 62 of the counterweight 44. The plate 66 is circular shaped including a bore 68 to receive the stroke adjustment mechanism 40.

The stroke adjustment mechanism 40 includes a hollow gear wheel 70 including teeth 72. The gear wheel 70 includes a shaft portion 74 projecting from the top of the gear wheel 70. The shaft portion 74 is received by the bearing 56 which is seated in the bore 52 of the counterweight portion 44. A circular base 76 is positioned into the bore of the plate 66. The base 76 includes an elliptical portion 78 that fits into an elliptical cutout 80 in the open end of the gear wheel 70. Thus, the base 76 is secured to the gear wheel 70 against independent rotation. Also, bores 82 extend thru the base to secure the base 76 with the plate 66. The gear wheel 70 includes a bore 84 that receives bearings 86 of the workpiece mounting assembly 36.

The workpiece mounting assembly 36 includes a shaft portion 88. The shaft portion includes a shaft 90 that projects into the bearings 86. Also, a workpiece securement portion 92 projects below the base 76 of the gear wheel 70.

The housing 42 includes a pair of portions 96, 98. The disk shaped housing portion 96 includes a bore 100 that receives a bearing 102 that receives the shaft 46 of the counterbalance assembly 34. The housing portion 96 is secured with housing portion 98. The housing portion 98 is ring shaped and defines a cavity 104. The ring shaped housing portion 98 includes a ring gear 106 inside the cavity 104 on the inner wall of the housing portion 98. The housing portion 98, at its one end, includes a groove 108 that receives the plate 66 of the counterweight assembly 34. The plate 66 rotates within the groove 108 of the housing portion 98.

In operation, the motor 12 is activated to rotate the pinion 18. The pinion 18 rotates the bevel gear 24. In turn, the bevel gear 24, keyed to shaft 46, rotates the counterbalance assembly 34. As the counterbalance assembly 34 is rotated, the plate 66 is rotated in the housing portion 98. The stroke adjustment mechanism 40 has its shaft 74 positioned in counterweight bore 52, via bearings 56. Thus, as the counterweight assembly 34 is rotated, the gear wheel 70 is rotated by the ring gear 106 as the gear wheel 70 rotates and moves around the cavity. The plate 66 is secured to the gear wheel 70 which, in turn, positions the workpiece mounting assembly 36 that is positioned within the gear wheel 70.

Thus, as the gear wheel 70 rotates, the shaft 90 of the workpiece mounting assembly also rotates within the bearings 86. The workpiece mounting assembly 36 rotates at a different rotational speed with respect to the gear wheel 70 usually at a slower speed of rotation compared to the rotation speed of the gear wheel 70. Thus, as the counterbalance assembly 34 is rotated, the gear wheel 70 is rotated within the cavity 104 of the housing part 98 along the gear ring 106. As this occurs, the workpiece mounting assembly 36 is rotated within the gear wheel 70. In turn, the workpiece 110 attached to the workpiece mounting assembly 36 is automatically adjusted as it rotates throughout its path. Thus, the stroke is adjusted upon rotation of the counterweight shaft and the workpiece mounting assembly. This variably adjust a stroke radius of the workpiece attachment mechanism with respect to the central axis of the housing, defined by the counterweight shaft 46. Thus, the stroke adjuster acts as a drivetrain automatically adjusting the mounting assembly stroke along the path illustrated in FIG. 9A.

Since the workpiece mounting assembly 36 rotates slower than the gear wheel 70, the axis of the shaft 90 remain in a line along the ring gear 106 as illustrated in the path lines in FIG. 9A. Thus, a dwell occurs so that the workpiece mounting assembly 36 follows a somewhat linear, flattened arc, path along the ring gear 106 before moving to the other side of plate 66. This is different from current rotatable machines where the workpiece mounting assemblies reach the edge of the path and returns in a tight radius to the other side of the machine. This causes a pigtail or swirl in the finish that requires a substantial amount of work for the user to eliminate compared to the linear effect of the disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An automatic adjustable stroke device for a random orbital machine comprising:

a housing having a central axis and a wall defining a cavity;

a counterbalance shaft assembly rotatably disposed at least partially within the cavity and a shaft portion of the counterbalance shaft assembly aligned with the central axis;

a mounting assembly disposed at least partially within the cavity, the mounting assembly including a workpiece attachment mechanism; and a stroke adjuster coupling the counterbalance shaft assembly with the mounting assembly, the stroke adjuster accommodated by the counterbalance shaft assembly enabling the mounting assembly to adjust its stroke upon rotation of the counterbalance shaft assembly, and the mounting assembly variably adjusts a stroke radius of the workpiece attachment mechanism with respect to the central axis of the housing, the stroke adjuster including a gear automatically adjusting the mounting assembly stroke.

2. The automatic adjustable stroke device of claim 1, wherein the counterbalance shaft assembly includes a bore for receiving accommodating the stroke adjuster.

3. The automatic adjustable stroke device of claim 1, wherein the stroke adjuster includes a bore for receiving the mounting assembly.

4. The automatic adjustable stroke device of claim 1, wherein the housing includes a ring gear meshing with the gear of the stroke adjuster.

5. The automatic adjustable stroke device of claim 1, wherein the counterbalance shaft assembly includes a counterweight portion.

6. The automatic adjustable stroke device of claim 5, wherein the counterweight portion is coupled with a base plate, the base plate rotatable with respect to the housing.

7. The automatic adjustable stroke device of claim 6, wherein the mounting assembly extends through the base plate to couple the workpiece attachment mechanism.

8. A rotating tool comprising:

a second housing and a motor, the motor including a drivetrain;

a first housing having a central axis and a wall defining a cavity;

a counterbalance shaft assembly rotatably disposed at least partially within the cavity and a shaft portion of the counterbalance shaft assembly aligned with the central axis;

a mounting assembly disposed at least partially within the cavity, the mounting assembly including a workpiece attachment mechanism; and a stroke adjuster coupling the counterbalance shaft assembly with the mounting assembly, the stroke adjuster is accommodated by the counterbalance shaft assembly enabling the mounting assembly to adjust its stroke upon rotation of counterbalance shaft assembly, and the mounting assembly variably adjusts a stroke radius of the workpiece attachment mechanism with respect to the central axis of the first housing, the stroke adjuster including a gear automatically adjusting the mounting assembly stroke.

9. The rotating tool of claim 8, wherein the counterbalance shaft assembly includes a bore for receiving the stroke adjuster.

10. The rotating tool of claim 8, wherein the stroke adjuster includes a bore for receiving the mounting assembly.

11. The rotating tool of claim 8, wherein the second housing includes a ring gear meshing with the gear of the stroke adjuster.

12. The rotating tool of claim 8, wherein the counterbalance shaft assembly includes a counterbalance portion.

13. The rotating tool of claim 12, wherein the counterbalance portion is coupled with a base plate, the base plate rotatable with respect to the second housing.

14. The rotating tool of claim 13, wherein the mounting assembly extends through the base plate to couple the workpiece attachment mechanism.

15. An automatic adjustable stroke device for a random orbital machine comprising:

a housing having a central axis and a wall defining a cavity;

a counterbalance shaft assembly rotatably disposed at least partially within the cavity and a shaft portion of the counterbalance shaft assembly aligned with the central axis;

a mounting assembly disposed at least partially within the cavity, the mounting assembly including a workpiece attachment mechanism; and a stroke adjuster coupling the counterbalance shaft assembly with the mounting assembly, the stroke adjuster assembly enabling the mounting assembly to adjust its stroke upon rotation of the counterbalance shaft assembly and the mounting assembly adjusts a stroke radius of the workpiece attachment mechanism with respect to the central axis of the housing so that the workpiece attachment mechanism dwells to provide a flattened arc travel path portion of the workpiece attachment mechanism during rotation of the shaft.

16. The automatic adjustable stroke device of claim 15, wherein the stroke adjuster includes a bore for receiving the mounting assembly.

17. The automatic adjustable stroke device of claim 16, wherein the mounting assembly rotates at a slower speed than the stroke adjuster.

* * * * *